US007141938B2

(12) United States Patent
Buij et al.

(10) Patent No.: US 7,141,938 B2
(45) Date of Patent: Nov. 28, 2006

(54) POWER CONTROL DEVICE, APPARATUS AND METHOD OF CONTROLLING THE POWER SUPPLIED TO A DISCHARGE LAMP

(75) Inventors: Arnold Willem Buij, Eindhoven (NL); Marcel Beij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/479,094

(22) PCT Filed: May 24, 2002

(86) PCT No.: PCT/IB02/01845

§ 371 (c)(1),
(2), (4) Date: Nov. 25, 2003

(87) PCT Pub. No.: WO02/098187

PCT Pub. Date: Dec. 5, 2002

(65) Prior Publication Data

US 2004/0155602 A1 Aug. 12, 2004

(30) Foreign Application Priority Data

May 31, 2001 (EP) ..... 01202067
Nov. 29, 2001 (EP) ..... 01204607

(51) Int. Cl.
*G05F 1/00* (2006.01)

(52) U.S. Cl. ..... 315/291; 315/307; 315/DIG. 4

(58) Field of Classification Search ..... 315/224–226, 315/247, 287, 291, 293, 307–308, DIG. 4, 315/DIG. 7

See application file for complete search history.

(56) References Cited

U.S. PATENT DOCUMENTS

| | | | | | |
|---|---|---|---|---|---|
| 4,503,364 | A * | 3/1985 | Engel | 315/308 |
| 4,928,038 | A | 5/1990 | Nerone | 315/209 R |
| 5,075,602 | A * | 12/1991 | Overgoor et al. | 315/307 |
| 5,198,726 | A * | 3/1993 | Van Meurs et al. | 315/224 |
| 5,463,287 | A * | 10/1995 | Kurihara et al. | 315/307 |
| 5,569,984 | A * | 10/1996 | Holtslag | 315/307 |
| 5,589,742 | A * | 12/1996 | Ueda | 315/307 |
| 5,615,093 | A * | 3/1997 | Nalbant | 363/25 |
| 5,623,187 | A * | 4/1997 | Caldeira et al. | 315/307 |
| 5,770,926 | A * | 6/1998 | Choi et al. | 315/307 |
| 5,806,055 | A | 9/1998 | Zinda, Jr. | 706/45 |
| 5,910,713 | A | 6/1999 | Nishi et al. | 315/308 |
| 5,969,482 | A * | 10/1999 | Gradzki | 315/224 |
| 6,191,568 | B1 * | 2/2001 | Poletti | 323/268 |
| 6,504,322 | B1 * | 1/2003 | Takahashi et al. | 315/307 |
| 6,515,882 | B1 * | 2/2003 | Moriguchi et al. | 363/97 |
| 6,815,912 | B1 * | 11/2004 | Ishihara et al. | 315/308 |

* cited by examiner

*Primary Examiner*—Thuy Vinh Tran

(57) ABSTRACT

The present invention relates to a power control device for controlling the output power supplied to a discharge lamp operated by an electrical power supply, comprising power level determining means for determining the actual lamp power level, error determining means for determining the error between the determined lamp power level and a specified reference power level, and output power determining means for maintaining the output power level supplied by the electrical power supply to the lamp if the error falls within a specified window and for adjusting the output power level supplied by the electrical power supply to the lamp towards said reference power level if the error falls outside the specified window.

27 Claims, 2 Drawing Sheets

POWER CONTROL DEVICE, APPARATUS AND METHOD OF CONTROLLING THE POWER SUPPLIED TO A DISCHARGE LAMP

This Application is a National Phase Application under 35 U.S.C. 371 claiming the benefit of PCT/IB02/01845 filed on May 24, 2002, which has priority based on European Applications (EPO) No. 01202067.3 filed on May 31, 2001 and No. 01204607.4 filed on Nov. 29, 2001.

The present invention relates to a device and a method of controlling the power supplied to a discharge lamp, such as fluorescent lamps, halogen lamps etc. operated by an electrical power supply.

Power control devices or ballasts are widely used for controlling the power supplied to the discharge lamp. Ballasts can be employed to optimize the preheating and ignition of the discharge lamp, to maintain a constant power to the electric discharge lamp for the purpose of maintaining a selected light intensity or for the purpose of controlled dimming to a fixed, but adjustable, power level of the discharge lamp.

U.S. Pat. No. 5,910,713 discloses an analog power control system wherein a lamp current detecting circuit provides a signal representative of the current in the lamp, which signal is used in a feedback loop to adjust the power supply to the lamp. This power control system aims to stabilize the current in the lamp. However, adjustment of the power supply to stabilize the lamp power is not realized.

U.S. Pat. No. 4,928,038 discloses an analog power control circuit with a power supply controlled by the switching frequency of a power switch. The power supplied to the lamp is controlled on basis of the detected current flowing through the power switch itself instead of the current in the lamp.

U.S. Pat. No. 5,806,055 discloses a digital ballast (power control device) wherein analog control loops are approximated by digital control loops. The digital ballasts provide a relatively low cost power control. Digital ballasts are versatile as compared to the analog ballasts and allow for easier implementation of complicated control and timing processes.

Generally the power source of the lamp is the mains and consequently the signal provided by the source contains a ripple (generally 100 Hz or 120 Hz). This ripple will also be present on the control loop signal, such as the measured lamp voltage and/or the measured lamp current. The digital control using the control loop signal will try to cancel the ripple. This can cause mixing of the sampling frequency and the ripple which may cause instability of the control loop resulting in visible light flicker.

The object of the present invention is to provide a power control device and a method for controlling the power supplied to a discharge lamp with improved stability.

According to a first aspect of the present invention a power control device for controlling the output power supplied to a discharge lamp operated by an electrical power supply is provided, comprising:

power level determining means for determining the actual lamp power level;

error determining means for determining the error between the determined lamp power level and a specified reference power level;

output power determining means for maintaining the output power level supplied by the electrical power supply to the lamp if the error is within a specified window and for adjusting the output power level supplied by the electrical power supply to the lamp towards said reference power level if the error is outside the specified window. The output power level is adjusted only if the difference between the reference power level, for example the (dimming-)level set by the user of the lamp, and the actual power level exceeds the specified value. This value is chosen so as to be larger than the ripple on the power consumed by the lamp. If the difference between the reference power level and the measured lamp power level is small, this difference is supposed to be caused by the ripple and consequently no corrective action is taken.

In a digital power control device the actual power level and the resulting error are determined repeatedly, for example with a clock rate of 500 Hz, and the output power level is adjusted iteratively towards the reference level.

On the one hand the window should be wide enough to get rid of the ripple. On the other hand the window should be narrow enough to provide a sufficient power control of a dimmed lamp. In a preferred embodiment the width of the window is therefore determined to be dependent on the specified reference power level. As the ripple on the DC supply voltage decreases with decreasing output power level because the current consumption of the power supply drops at low output power, the window is tightened towards lower reference power levels.

In a further preferred embodiment the output power determining means comprise means for varying the window width between a maximum window width and a minimum window width, the ratio of which is preferably approximately 1/10 or more. A minimum window width should be maintained to cancel limit cycle oscillations which would occur due to lack of input and/or output resolution (for example determined by the resolution of the A/D- and D/A-converters). Therefore the maximum and minimum window widths are variable, dependent on the resolution of the electronic circuitry (micro controller) used. In case of a microcontroller with high resolution, a large ratio is preferred.

In a further preferred embodiment the output power determining means comprise means for determining the reference power level on basis of a prestored nominal lamp power level and a dimming level, which is input to the output power determining means. This makes the power control devices suited for different types of lamps (50 W, 60 W, etc). Changing between lamp types takes the substitution of the value of the nominal power only, which is preferably stored in a microcontroller to be described hereafter, to adapt the power control device to the specific type of lamp.

In further preferred embodiment one or more of the corrections are dependent on the error level. When the error is large, the control device will iteratively correct the output power using a relatively large step size, while when the error is small the control device iteratively corrects the output power by using a relatively small step size.

In a further preferred embodiment the output power determining means and error determining means comprise a programmable microcontroller (MC) connected to an interface circuit (IFC). The microcontroller is programmable by storing software in its memory. Adaptation of the control device to different lamp types and implementation of complicated control and timing processes can be achieved by adaptation of the software running on the microcontroller.

In a preferred embodiment the output power determining means can be connected to one or more switching elements of the electrical power supply for controlling the output power by controlling the switching of the switching elements. The output power supplied to the lamp is in this embodiment dependent on the cycle of the switching elements.

According to another aspect of the present invention an apparatus is provided for supplying power to a discharge lamp, preferably comprising the earlier described power control device, the apparatus comprising:

an electrical duty cycle controlled power supply for supplying power to the lamp;

power level determining means for determining the actual level of the lamp power;

error determining means for determining the error between the determined lamp power level and a specified reference power level;

output power determining means, connected to the power supply for controlling the duty cycle of the power supply so as to adjust the output power to be supplied to the lamp towards said reference power level only if the error falls outside a specified window. In this apparatus preferably the earlier mentioned power control device is applied. In a preferred embodiment the DC power supply is controllable and the power determining means control the output voltage (UDC) of the DC power supply as to adjust the output power. In this embodiment a supply voltage variation method is applied for controlling the output power. In yet another preferred embodiment the operation frequency of the power supply is controllable and the power determining means control the output voltage of the DC power supply so as to adjust the output power. In this embodiment a frequency variation method is applied for controlling the output power.

According to another aspect of the present invention a method is provided of controlling the power supplied to a discharge lamp operated by an electrical power supply, comprising:

determining the actual power level of the power consumed by the lamp;

determining the error between the actual lamp power level and a specified reference power level;

if the error falls within a specified window, maintaining the output power level supplied to the lamp;

if the error falls outside the specified window, adjusting the output power level supplied to the lamp towards said reference power level, the width of the window being preferably dependent on the specified reference power level.

Further advantages, features and details are given in the following description of a preferred embodiment of the invention. In the description reference is made to the annexed figures.

The lamp power supply according to the preferred embodiment of the invention is a duty cycle controlled power supply of the constant frequency pulse width modulation (PWM) type, which uses the same frequency for ignition, normal operation and dimmed operation of the lamp. In the embodiment shown in FIG. 1, the power supply is a half-bridge, which produces a square wave signal and serves for ignition and normal/dimmed operation of the lamp.

The power supply operates in the symmetrical mode. The duty cycle of the two switching elements are equal, their on-times being separated from each other by ½ of the switching period. In the ignition phase the L-C combination $L_{lamp}$, $C_{lamp}$ is unloaded which generates a high voltage across the lamp. This causes ignition of the lamp. In the burn phase the L-C combination $L_{lamp}$ and $C_{lamp}$ is loaded by the lamp. The power delivered to the lamp is determined by duty cycle. Hence, the lamp power supply is controlled by one parameter, the duty cycle for the switching elements.

Figure 1:
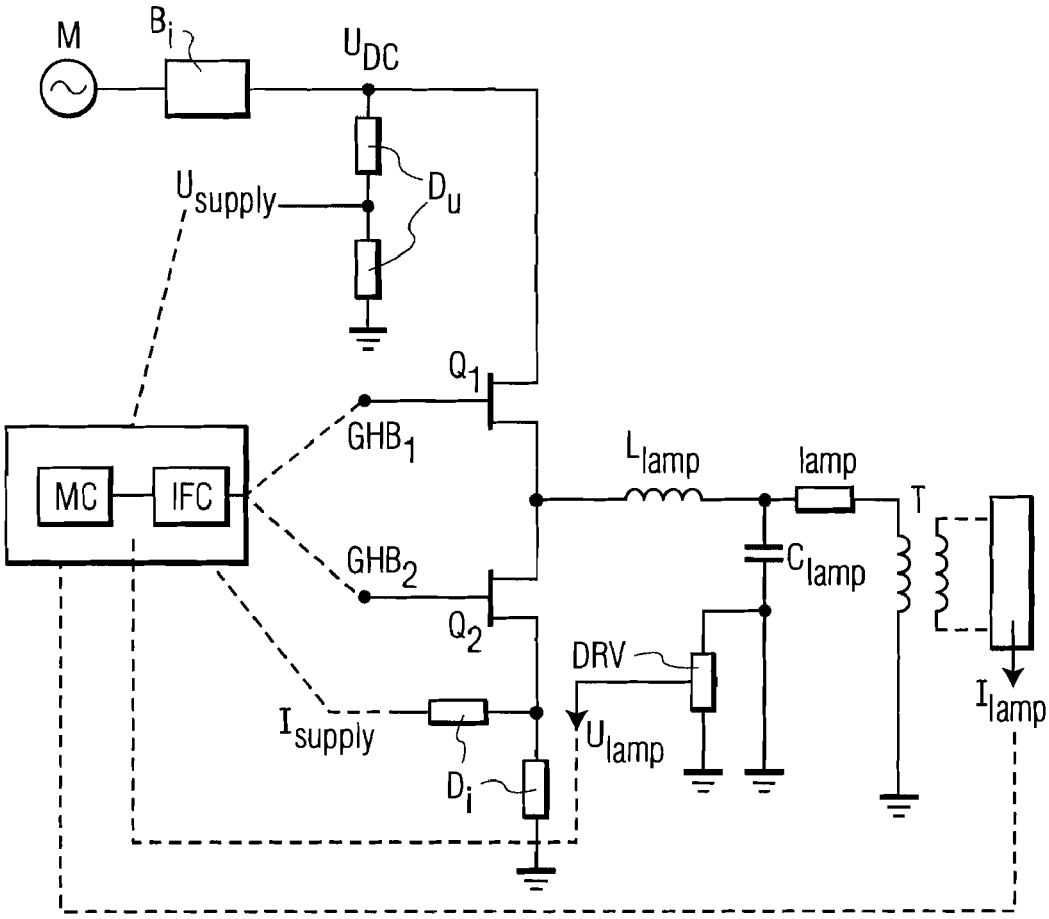
FIG. 1 is a block diagram showing the preferred embodiment of the present invention for operating the discharge lamp.

In the block diagram of FIG. 1 it is shown that a diode bridge B1 is connected to the mains (220 V AC). The bridge B1 rectifies the mains and provides a DC supply voltage of about 300 V.

For driving the lamp a half-bridge drive circuit is shown, wherein the switching elements are formed by two power transistors (power FETs) Q1 and Q2. The gates of the switching elements Q1 and Q2 are driven by driver signals GHB1 and GHB2 originating from a control circuit to be described hereafter.

Further are shown a DC blocking capacitor CDC, a LC-combination $L_{lamp}$, $C_{lamp}$ for driving the lamp, and a microcontroller MC connected to an interface circuit (IFC) for providing the control signals GHB1 and GHB2 for power transistor Q1 and Q2 respectively. As the microcontroller operates on a relatively low voltage (typical 5 V supply voltage), the input signals must be in the range from 0 to 5V and consequently the output signals that the microcontroller can deliver are also in this range. Consequently, the interface circuit (IFC) is provided for converting voltages and currents into usable indication signals for the microcontroller (MC) and for converting control signals from the microcontroller (MC) into usable driver signals for the switching elements Q1 and Q2. The microcontroller MC is provided with A/D-converters and D/A converters, read-only memory (ROM), programmable or non-programmable, and/or random access memory (RAM). In the memory control software is stored.

Although not shown in FIG. 1, electrode heating circuits, which are used to preheat the electrodes before ignition of the lamp, and various types of protection circuits, etc. can also be provided.

The microcontroller MC outputs, under software control, a square wave, which is averaged in the interface circuit with an RC-filter to rule out the ripple component. The resulting DC-voltage is used by the interface circuit (IFC) to generate the driver signals GHB1 and GHB2 for the switching elements Q1 and Q2 respectively. Consequently, the duty cycle, with which the power supply to the lamp is controlled, is determined by software stored in the memory of the microcontroller.

The functions of stabilization of the power or current in the lamp, the optimization of the ignition, preheating and electrode heating, the adaptation to different lamp types, can be achieved by adapting the software running on the microcontroller. These functions are implemented by a digital control loop for which the microcontroller performs measurements of a plurality of physical quantities such as the current in the lamp, the voltage across the lamp, the supply current and supply voltage.

$I_{lamp}$ is the current running in the lamp. $I_{lamp}$ can be determined in various ways. In the embodiment of FIG. 1, $I_{lamp}$ is determined by a lamp current transformer T, the primary windings of which are connected between an electrode of the lamp and ground. The voltage of the secondary windings of the lamp current transformer T is rectified in a bridge circuit (not shown) and averaged. The resulting signal is representative of the lamp current $I_{lamp}$.

$U_{lamp}$ is the actual voltage across the lamp. $U_{lamp}$ can be determined in various ways. In the embodiment of FIG. 1, $U_{lamp}$ is represented by the voltage taken from a high-ohmic divider and rectifier circuit (DRV).

$I_{supply}$ is represented by the averaged voltage across the shunt resistor of divider $D_I$, while $U_{supply}$ is represented by the averaged voltage from divider $D_U$.

The signals $I_{lamp}$, $U_{lamp}$, $U_{supply}$ and $I_{supply}$ are fed to the interface circuit (IFC) that converts the signals into usable indication signals for the microcontroller.

The actual lamp power can be calculated by simultaneously measuring voltage $U_{lamp}$ across the lamp, measuring the current $I_{lamp}$ running in the lamp and subsequently, multiplying of the measured voltage $U_{lamp}$ and current $I_{lamp}$. This multiplication is performed in the microcontroller. It also conceivable to calculate an averaged power level by applying for example the following exponential digital filter:

$$P_{lamp,n}:=P_{lamp,n-1}*(1-a)+a*I_{lamp,n-1}*U_{lamp,n-1}$$

wherein $P_{lamp,n}$ is the power of the lamp value calculated for time n, $P_{lamp,n-1}$, $U_{lamp,n-1}$ and $I_{lamp,n-1}$ are the power, the voltage and the current for time n-1, and a is a constant (0<a<1).

The thus obtained control input power $P_{lamp,n}$ is compared to a reference power level $P_{ref}$, which represents the actual desired power level (target level). The reference power level is obtained by multiplication of the nominal lamp power, which is prestored in the memory of microcontroller MC and is dependent on the specific lamp used, and one of a number of prestored values representative of the dimming level of the lamp. The dimming level can be set in a variety of ways, for example by adjustment of a switch (not shown) to be operated by the operator.

The lamp power control procedure implemented by the software running on the microcontroller is aimed to maintain the lamp power at the value according to the reference power level or dimming level. The control procedure can be realized by applying fuzzy rules sets, more specifically by applying the fuzzy rules in an integrating window process.

Figure 2:
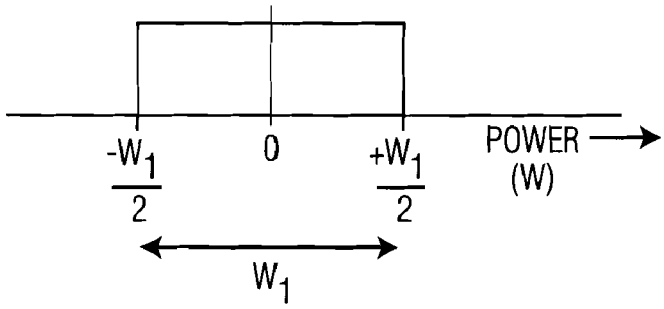
FIG. 2 shows an integrating window to be applied on the deviation between the output power and reference power.

In the integrating window process the magnitude and sign of the deviation (error) of the measured power level from the reference power level determines which action is to be taken. In FIG. 2 a window is shown running from −W/2 to +W/2. If the deviation is inside the {−W/2, +W/2} window, no corrective action is taken. If the deviation is outside the {−W/2, +W/2} window, the microcontroller takes a corrective action, resulting in a corrected value of the output of the microcontroller. This results in corrected values of the duty cycles of GHB1 and GHB2 and consequently the output lamp power $P_{lamp}$.

Figure 3:
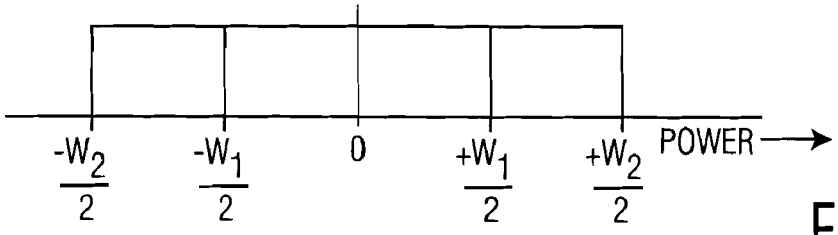
FIG. 3 shows two integrating windows to be applied on the deviation between the output power and reference power.

Above a description is given of how the microcontroller implements an integrating window control process using only one integrating window. In a further preferred embodiment the microcontroller implements an integrating window control process using two or more windows, as is shown in FIG. 3. If, for example, the deviation is inside a first $\{-W_1/2, +W_1/2\}$ (sub) window, no correction is applied. If the deviation is outside the first (sub) window $\{-W_1/2, +W_1/2\}$, but inside a second window $\{-W_2/2, +W_2/2\}$, a first correction $C_1$ is applied, while if the deviation is outside the $\{-W_2/2, +W_2/2\}$ window, a second correction $C_2$, larger than the first correction $C_1$, is applied. In the embodiment shown the corrections $C_1$ and $C_2$ are implemented by increasing or decreasing the output power by respectively a relatively small and a relatively large step size. If for example the operator operates the above mentioned switch and sets the dimming level and hence the reference power level to half of its original value, this causes a negative deviation outside the relatively wide window as a result of which the microcontroller responds with a fast decrease of the output power level. After a while the deviation will reach the range within the relatively wide window, but outside the relatively narrow window as a result of which a slow decrease, or increase if the deviation becomes positive, of the output power level occurs.

In the above embodiment the corrections are implemented as relatively small and relatively large step sizes of constant value. This means that the correction is independent on the deviation (error) of the measured power level from the reference power level. However, in another embodiment the output power supplied to the lamp, or at the least the duty cycle of the power supplied to the lamp satisfies:

$$P_n=P_{n-1}+K_p(E_n-E_{n-1})+K_iE_n$$

wherein $P_n$ is (the duty cycle of) the output power level supplied to the lamp on time n, $P_{n-1}$ is (the duty cycle of) the output power level supplied to the lamp of the current sample, $E_n$ and $E_{n-1}$ the error of the current sample and of the previous sample, $K_p$ is the proportional gain and $K_i$ is the integrating gain. When the gain factors are nullified for error signals satisfying −W/2<E<+W/2, then we have a one window integrating/proportional digital control. This is also applicable to two or more windows. When the gain factors are nullified for error signals satisfying $-W_1/2<E<+W_1/2$, have a relatively small value if $-W_2/2<E<-W_1/2$ or if $+W_1/2<E<+W_2/2$ and have a relatively large value if $E<-W_2/2$ or $E>+W_2$, then a two window integrating/proportional digital control is achieved. In this embodiment the correction of the output power is dependent on the error E and the process of iteration to correct the output power will converge in a relatively short time.

As the DC-source of the power supply is the rectified mains, the signal provided by the source contains a ripple (generally 100 Hz or 120 Hz). This ripple will also be present on the measured lamp voltage $U_{lamp}$ and measured lamp current $I_{lamp}$ and consequently on the calculated duty cycle of lamp power $P_{lamp}$. The digital control will try to cancel the ripple. This can cause mixing of the sampling frequency and the ripple which may cause instability of the control loop resulting in visible light flicker. Therefore the window must have sufficient width to keep the control loop stable. To lose the ripple on the measured lamp power, the window should have a width of at least 10% of the nominal power of the lamp (i.e. $W=0.1*P_{nominal}$). A high frequency power supply for a lamp of 50 W nominal power needs for example an anti-ripple window of +/−2.5 W (i.e. W=2.5). If the output power level is dimmed to 5 W and the same window would have been applied, the control tolerance would be 2.5 W to 7.5 W. In the latter case the window is so wide that power control is insufficient.

Figure 4:
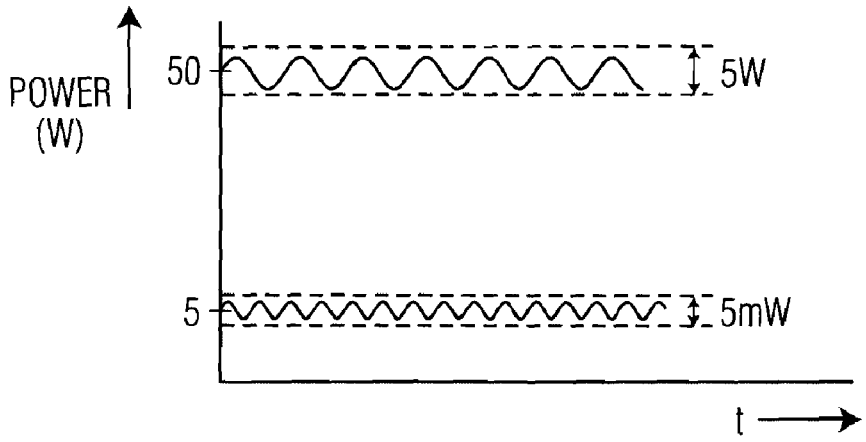
FIG. 4 shows a graph of the ripple on the lamp power when the lamp is operated at a nominal power level and a dimmed power level.

The ripple on the DC supply voltage decreases with increasing dimming because the current consumption of the high frequency power generator drops at low output power. FIG. 4 shows the ripple on the DC supply voltage to the lamp, in case it is driven at its nominal power of 50 W and in case it is driven at a dimmed power level of 5 W. The maximum ripple at nominal power is approximately 5 W, which is about 10% of the nominal power. Hence, a window from −2.5 W to +2.5 W ($W_1$=5 W) is sufficient to keep the control loop stable. The ripple at the dimmed power level of 5 W is approximately 50 mW, which is about 0.1% of the nominal power of the lamp. In this case a window only ranging from −25 mW to +25 mW ($W_1$=50 mW) would be sufficient to keep the control loop stable. Therefore the window is tightened towards a higher degree of dimming.

A minimum window width should, however, be maintained to cancel limit cycle oscillations which would occur due to lack of input and/or output resolution (for example determined by the resolution of the A/D- and D/A-converters).

In the preferred embodiment the window width is prestored in the memory of the microcontroller (MC) as function of the reference power or as function of the dimming level.

Figure 5:
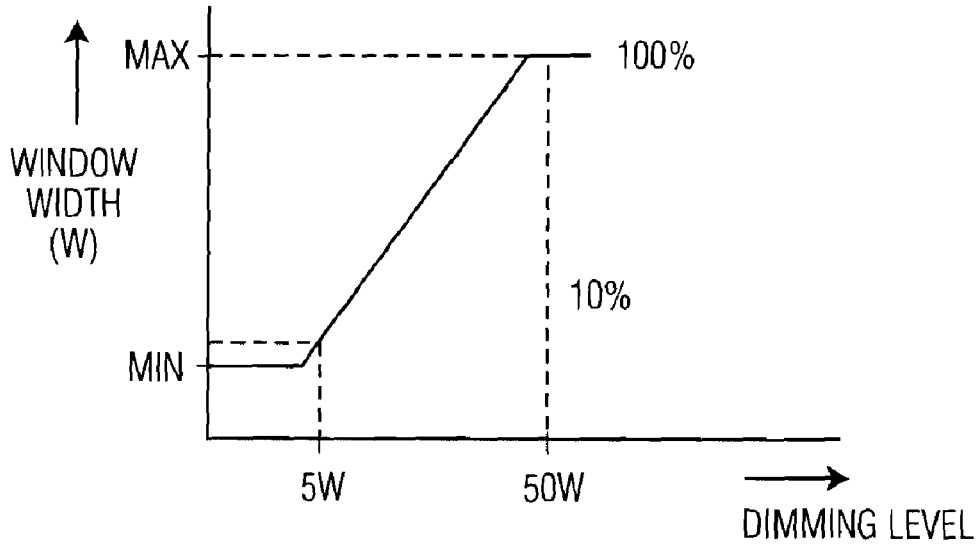
FIG. 5 shows the window width as function of the dimming level for a gliding window.

In the memory tables containing a plurality of window width values and corresponding dimming level values are stored, which are retrieved from the memory depending on the dimming level set by the operator. FIG. 5 shows a continuous curve representing the window width as function of the dimming level of the lamp. When the lamp is operated at nominal power of 50 W, a maximum window width $W_1$ of 5 W is applied. The control tolerance is +47.5 W to +52.5 W, enabling a sufficient power control. When the lamp is operated at a dimmed power level of 5 W, the window width glides iteratively to a window width $W_1$ of 1 W, i.e. a decrease to approximately ⅕ of it's maximum size. The control tolerance in this case is +4.5 W to +5.5 W, which enables a sufficient power control When the lamp is operated at a further dimmed power level of less than 10% of the nominal power, the window width is further decreased until the width reaches the minimum window width which inter alia is dependent on the resolution of the microcontroller and its A//D- and D/A-converters.

FIG. 5 shows a window width that linearly decreases with decreasing output power. However, a non-linear decrease of the window width can be advantageous, for example a relatively slow decrease in the region of the maximum output power and a relatively fast decrease in the region of the minimum output power.

The invention claimed is:

1. Power control device for controlling an output power supplied to a discharge lamp operated by an electrical power supply, comprising:

power level determining means for determining an actual lamp power level;

error determining means for determining an error between the determined lamp power level and a specified reference power level;

output power determining means for maintaining an output power level supplied by the electrical power supply to the lamp if the error falls within a specified window and for adjusting the output power level supplied by the electrical power supply to the lamp towards said reference power level if the error falls outside the specified window, wherein said reference power level is a determined by a preset nominal lamp power and an input dimming level.

2. Power control device according to claim 1, wherein a width of the window exceeds a ripple on a lamp power.

3. Power control device according to claim 1, wherein a width of the window is dependent on the specified reference power level.

4. Power control device according to claim 1, wherein the output power determining means comprise means for decreasing the window width towards low reference power levels and increase a window width towards high reference power levels.

5. Power control device according to claim 1, wherein the output power determining means comprise means for iteratively adjusting the output power level with a first correction if the error is outside the window, and maintaining the output power level if the error is inside the window.

6. Power control device according to claim 5, wherein one or more of the corrections are dependent on the error level.

7. Power control device according to claim 1, the power level determining means comprising:

means for determining an actual voltage across the lamp;

means for determining an actual current in the lamp;

means for determining the actual power level from the actual voltage and actual current.

8. Power control device according to claim 1, wherein the output power determining means and error determining means comprise a programmable microcontroller (MC) connected to an interface circuit (IFC).

9. Power control device according to claim 1, wherein the output power determining means is connectable to one or more switching elements of the electrical power supply for controlling the output power supplied to the lamp by controlling the switching of the switching elements.

10. Power control device for controlling an output power supplied to a discharge lamp operated by an electrical power supply, comprising:

power level determining means for determining an actual lamp power level;

error determining means for determining an error between the determined lamp power level and a specified reference power level; and output power determining means for maintaining an output power level supplied by the electrical power supply to the lamp if the error falls within a specified window and for adjusting the output power level supplied by the electrical power supply to the lamp towards said reference power level if the error falls outside the specified window;

wherein the output power determining means comprise means for varying a window width between a maximum window width and a minimum window width, a ratio of which is preferably approximately 1/10 or more.

11. Power control device according to claim 10, wherein the ratio of the maximum and minimum window width is in the same order as a ratio of a maximum output power and a minimum output power, limited by boundaries of a predetermined minimum and a predetermined maximum window width.

12. Power control device for controlling an output power supplied to a discharge lamp operated by an electrical power supply, comprising:

power level determining means for determining an actual lamp power level;

error determining means for determining an error between the determined lamp power level and a specified reference power level; and output power determining means for maintaining an output power level supplied by the electrical power supply to the lamp if the error falls within a specified window and for adjusting the output power level supplied by the electrical power supply to the lamp towards said reference power level if the error falls outside the specified window;

wherein the output power determining means comprise means for determining the reference power level on basis of a prestored nominal lamp power level and a dimming level, which is input to the output power determining means.

13. Power control device for controlling an output power supplied to a discharge lamp operated by an electrical power supply, comprising:

power level determining means for determining an actual lamp power level;

error determining means for determining an error between the determined lamp power level and a specified reference power level; and output power determining means for maintaining an output power level supplied by the electrical power supply to the lamp if the error falls within a specified window and for adjusting the output power level supplied by the electrical power supply to the lamp towards said reference power level if the error falls outside the specified window;

wherein the output power determining means comprise means for iteratively adjusting the output power level with a first correction if the error is outside the window, and maintaining the output power level if the error is inside the window; and wherein the output power means comprise means for adjusting the output power level supplied by the power supply with a second correction respectively if the error is inside the main window, but outside a subwindow of the main window, the second correction being smaller than the first correction respectively.

14. Power control device according to claim 13, wherein said first and second corrections are factors which are prestored in the output power means.

15. Power control device for controlling an output power supplied to a discharge lamp operated by an electrical power supply, comprising:

power level determining means for determining an actual lamp power level;

error determining means for determining an error between the determined lamp power level and a specified reference power level; and output power determining means for maintaining an output power level supplied by the electrical power supply to the lamp if the error falls within a specified window and for adjusting the output power level supplied by the electrical power supply to the lamp towards said reference power level if the error falls outside the specified window;

wherein the output power determining means comprise means for iteratively adjusting the output power level with a first correction if the error is outside the window, and maintaining the output power level if the error is inside the window; and wherein the output power level supplied to the lamp satisfies:

$$P_n=P_{n-1}+K_p(E_n-E_{n-1})+K_iE_n$$

wherein $P_n$ is the (output power level supplied to the lamp on time n, $P_{n-1}$ is the (output power level supplied to the lamp on time n−1, $E_n$ and $E_{n-1}$ are the error on time n and n−1 respectively, $K_p$ is a proportional gain and $K_i$ is an integrating gain.

16. Apparatus for supplying power to a discharge lamp, comprising:

an electrical power supply for supplying power to the lamp;

power level determining means for determining an actual level of the lamp power;

error determining means for determining an error between the determined lamp power level and a specified reference power level;

output power determining means, connected to the power supply for controlling the output power so as to adjust the output power to be supplied to the lamp towards said reference power level only if the error falls outside a specified window, wherein said reference power level is a determined by a preset nominal lamp power and an input dimming level.

17. Apparatus according to claim 16, wherein a DC power supply (UDC) is controllable and the power level determining means control the output voltage (UDC) of the DC power supply as to adjust the output power supplied to the lamp.

18. Apparatus according to claim 16, wherein an operation frequency (at GHB1, GHB2) is controllable and the power determining means control the output voltage (UDC) of the DC power supply so as to adjust the output power supplied to the lamp.

19. Apparatus according to claim 16, wherein the power supply is a switched-mode power supply (SMPS).

20. Apparatus according to claim 16, wherein the power supply is of a constant frequency pulse width modulation (PWN) type.

21. Apparatus according to claim 16, comprising a power control device.

22. Method of controlling a power supplied to a discharge lamp operated by an electrical power supply, comprising:

determining an actual power level consumed by the lamp;

determining an error between the actual lamp power level and a specified reference power level;

if the error falls within a specified window, maintaining the actual Output power level supplied to the lamp;

if the error falls outside the specified window, adjusting the actual output power level supplied to the lamp towards said reference power level, wherein said reference power level is a determined by a preset nominal lamp power and an input dimming level.

23. Method according to claim 22, wherein a window width is dependent on the specified reference power level.

24. Method according to claim 22, wherein a window width is decreased towards low reference power levels and increased towards high reference power levels.

25. Method of controlling a power supplied to a discharge lamp operated by an electrical power supply, comprising the acts of:

determining an actual power level consumed by the lamp;

determining an error between the actual lamp power level and a specified reference power level;

if the error falls within a specified window, maintaining the actual output power level supplied to the lamp;

if the error falls outside the specified window, adjusting the actual output power level supplied to the lamp towards said reference power level;

wherein a window width is variable between a maximum window width and a minimum window width, a ratio of which is approximately 1/10 or more.

26. Method of controlling a power supplied to a discharge lamp operated by an electrical power supply, comprising the acts of:

determining an actual power level consumed by the lamp;

determining an error between the actual lamp power level and a specified reference power level;

if the error falls within a specified window, maintaining the actual output power level supplied to the lamp;

if the error falls outside the specified window, adjusting the actual output power level supplied to the lamp towards said reference power level;

wherein the reference power level is a determined by a preset nominal lamp power and an input dimming level.

27. Power control for controlling an output power supplied to a discharge lamp operated by an electrical power supply, comprising:

power level determining means for determining an actual lamp power level;

error determining means for determining an error between the determined lamp power level and a specified reference power level; and output power determining means for maintaining an output power level supplied by the electrical power supply to the lamp if the error falls within a specified window and for adjusting the output power level supplied by the electrical power supply to the lamp towards said reference power level if the error falls outside the specified window;

wherein the output power determining means comprise means for iteratively adjusting the output power level with a first correction if the error is outside the window, and maintaining the output power level if the error is inside the window; and wherein a duty cycle of the output power level supplied to the lamp satisfies:

$$P_n = P_{n-1} + K_p(E_n - E_{n-1}) + K_i E_n$$

wherein $P_n$ is the duty cycle of the output power level supplied to the lamp on time n, $P_{n-1}$ is the duty cycle of the output power level supplied to the lamp on time n−1, $E_{n\ and\ En-1}$ are the error on time n and n−1 respectively, $K_p$ is a proportional gain and $K_i$ is an integrating gain.

* * * * *